US010655394B2

(12) United States Patent
Sadabadi et al.

(10) Patent No.: US 10,655,394 B2
(45) Date of Patent: May 19, 2020

(54) DRILLING APPARATUS WITH FIXED AND VARIABLE ANGULAR OFFSETS

(71) Applicant: Halliburton Energy Services, Inc., Houston, TX (US)

(72) Inventors: Hamid Sadabadi, Edmonton (CA); Hossam Gharib, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 322 days.

(21) Appl. No.: 15/576,598

(22) PCT Filed: Jul. 9, 2015

(86) PCT No.: PCT/CA2015/050369
§ 371 (c)(1),
(2) Date: Nov. 22, 2017

(87) PCT Pub. No.: WO2017/004691
PCT Pub. Date: Jan. 12, 2017

(65) Prior Publication Data

US 2018/0163476 A1 Jun. 14, 2018

(51) Int. Cl.
*E21B 7/06* (2006.01)

(52) U.S. Cl.
CPC ..... *E21B 7/062* (2013.01); *E21B 7/067* (2013.01)

(58) Field of Classification Search
CPC ..... E21B 7/06; E21B 7/067
See application file for complete search history.

(56) References Cited

U.S. PATENT DOCUMENTS

| | | | | |
|---|---|---|---|---|
| 3,903,974 | A | 9/1975 | Cullen | |
| 4,442,908 | A | 4/1984 | Steenbock | |
| 4,492,276 | A * | 1/1985 | Kamp | E21B 4/02 175/61 |
| 4,699,224 | A | 10/1987 | Burton | |
| 4,880,067 | A | 11/1989 | Jelsma | |
| 4,884,643 | A | 12/1989 | Wawrzynowski et al. | |
| 5,022,471 | A | 6/1991 | Maurer et al. | |
| 5,099,931 | A | 3/1992 | Krueger et al. | |

(Continued)

FOREIGN PATENT DOCUMENTS

WO 1995004867 2/1995

OTHER PUBLICATIONS

Black Max Downhole Tools Ltd., "Black Max Operations Handbook", Jun. 2002, 7th edition, Black Max Downhole Tools Ltd., Canada.

(Continued)

*Primary Examiner* — Shane Bomar
(74) *Attorney, Agent, or Firm* — Terrence N. Kuharchuk; Parlee McLaws LLP; Craig W. Roddy

(57) ABSTRACT

A drilling apparatus including a housing having a housing bore, a proximal housing end, and a distal housing end, a driveshaft rotatably supported within the housing bore, a fixed first angular offset axially located between the proximal housing end and the distal housing end, and a variable second angular offset axially located between the proximal housing end and the distal housing end. The drilling apparatus may have a reduced stiffness section so that the drilling apparatus bends preferentially at the reduced stiffness section, and the variable second angular offset may be axially located at the reduced stiffness section.

20 Claims, 4 Drawing Sheets

(56) References Cited

U.S. PATENT DOCUMENTS

| | | | | |
|---|---|---|---|---|
| 5,101,914 | A | 4/1992 | Wenzel | |
| 5,135,060 | A | 8/1992 | Ide | |
| 5,139,094 | A | 8/1992 | Prevedel et al. | |
| 5,368,109 | A | 11/1994 | Pittard, Jr. et al. | |
| 5,445,230 | A | 8/1995 | Wattenburg et al. | |
| 5,452,772 | A | 9/1995 | Van Den Bergh | |
| 5,727,641 | A | 3/1998 | Eddison et al. | |
| 5,738,178 | A | 4/1998 | Williams et al. | |
| 5,857,531 | A * | 1/1999 | Estep | E21B 4/02 175/101 |
| 6,216,802 | B1 * | 4/2001 | Sawyer | E21B 7/067 175/61 |
| 6,550,818 | B2 | 4/2003 | Robin | |
| 6,942,044 | B2 | 9/2005 | Moore et al. | |
| 7,383,897 | B2 | 6/2008 | Moody et al. | |
| 7,861,802 | B2 | 1/2011 | Underwood et al. | |
| 7,909,117 | B2 | 3/2011 | Van Steenwyk et al. | |
| 8,141,658 | B2 | 3/2012 | Blair et al. | |
| 8,640,792 | B2 | 2/2014 | Underwood et al. | |
| 2002/0175003 | A1 * | 11/2002 | Pisoni | E21B 7/067 175/74 |
| 2004/0104051 | A1 * | 6/2004 | Moriarty | E21B 7/06 175/57 |
| 2004/0238221 | A1 * | 12/2004 | Runia | E21B 7/067 175/61 |
| 2012/0037428 | A1 | 2/2012 | Plop | |
| 2013/0168152 | A1 | 7/2013 | Panahi | |
| 2013/0240268 | A1 * | 9/2013 | Crowley | E21B 7/068 175/61 |
| 2013/0319764 | A1 * | 12/2013 | Schaaf | E21B 7/06 175/24 |
| 2014/0190750 | A1 | 7/2014 | Samuel | |
| 2014/0209389 | A1 | 7/2014 | Sugiura et al. | |
| 2014/0251695 | A1 | 9/2014 | Marchand et al. | |
| 2014/0360787 | A1 | 12/2014 | Williams et al. | |
| 2016/0312535 | A1 * | 10/2016 | Ritchie | F16C 17/105 |
| 2017/0247947 | A1 * | 8/2017 | Savage | E21B 4/02 |

OTHER PUBLICATIONS

Petrowiki, "Directional deviation tools", downloaded from "http://petrowiki.org/Directional_deviation_tools", Published by Society of Petroleum Engineers (SPE International), 2015 (5 pages).

SPE/IADC 140245, 2011 Speiiadc Drilling Conference: Conference theme is 'Being the best—growing our business', downloaded from "http://www.drillingcontractor.org/2011-speiadc-drilling-conference-8172", 2011 (1 page).

Gyrodata Incorporated, "Mud Motor Handbook", 2013 Edition, updated 2016, Gyrodata Incorporated, Houston, Texas.

Sperry-Sun Drilling Services, Brochure entitled "Sperry Drill Positive Displacement Motors", Sperry-Sun Drilling Services, Houston, Texas, 1991 (8 pages).

Ingold, Charles, "Short-radius drilling: a decade of development", Drilling Contractor, Jul./Aug. 2007, pp. 74-76.

* cited by examiner

DRILLING APPARATUS WITH FIXED AND VARIABLE ANGULAR OFFSETS

TECHNICAL FIELD

A drilling apparatus having a fixed angular offset and a variable angular offset, for use in directional drilling.

BACKGROUND OF THE INVENTION

Directional drilling of a borehole may be performed using a drilling apparatus having an angular offset (i.e., bend). The rate of directional change of the borehole which may be achievable with a drilling apparatus generally increases with the magnitude of the angular offset. The lateral and bending stresses imposed on the drilling apparatus during drilling also generally increase with the magnitude of the angular offset.

BRIEF DESCRIPTION OF DRAWINGS

Embodiments of the invention will now be described with reference to the accompanying drawings, in which:

FIG. 4A and FIG. 4B are longitudinal section assembly views of a drilling apparatus including a fixed first angular offset and a variable second angular offset, wherein FIG. 4B is a continuation of FIG. 4A, and wherein the magnitude of the variable second angular offset is depicted as zero.

FIGS. 5A, 5B and 5C are isolated views of a first exemplary embodiment of a reduced stiffness section in a drilling apparatus, wherein FIG. 5A is a pictorial view, FIG. 5B is a transverse section view, and FIG. 5C is a longitudinal section view.

FIGS. 6A, 6B and 6C are isolated views of a second exemplary embodiment of a reduced stiffness section in a drilling apparatus, wherein FIG. 6A is a pictorial view, FIG. 6B is a transverse section view, and FIG. 6C is a longitudinal section view.

DETAILED DESCRIPTION

Figure 1:
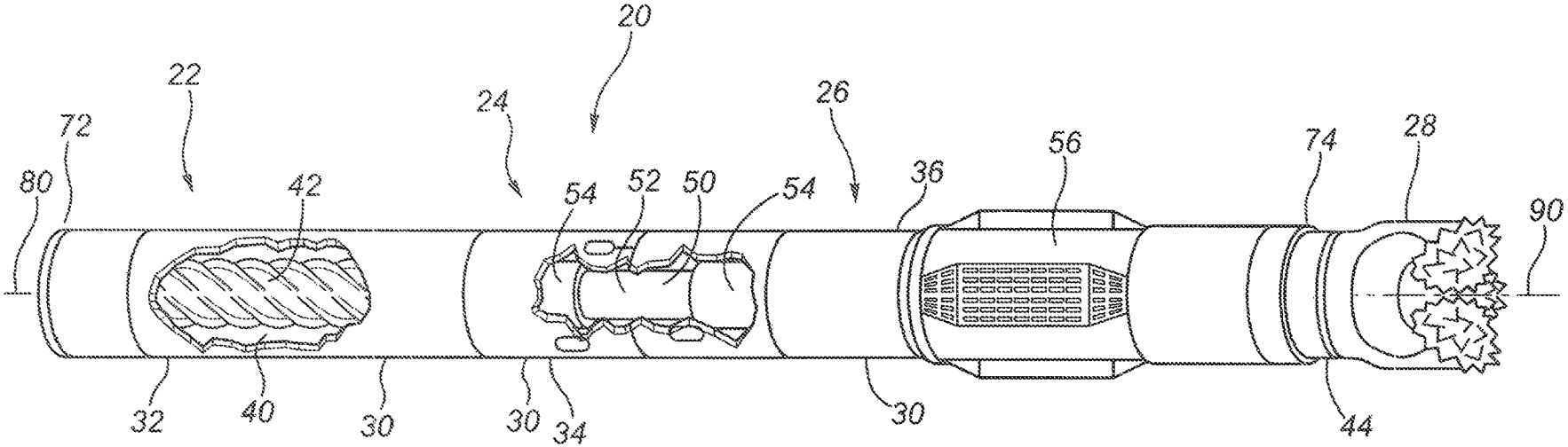
FIG. 1 is a pictorial view of a drilling apparatus comprising a drilling motor.

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

References in this document to "proximal" mean located relatively toward an intended "uphole" end, "upper" end and/or "surface" end of a borehole or of an object positioned in a borehole.

References in this document to "distal" mean located relatively away from an intended "uphole" end, "upper" end and/or "surface" end of a borehole or of an object positioned in a borehole.

The present disclosure is directed at a drilling apparatus and at specific features of a drilling apparatus. The drilling apparatus may be configured to be inserted and/or contained and/or used in a borehole. In some embodiments, the drilling apparatus may be used for drilling a borehole.

The drilling apparatus may comprise any apparatus which is suitable for drilling. In some particular embodiments, the drilling apparatus may comprise, consist of, or consist essentially of a rotary steerable drilling apparatus for use in drilling a borehole. In some embodiments, the drilling apparatus may comprise, consist of, or consist essentially of a drilling motor for use in drilling a borehole.

In some embodiments, the drilling apparatus may comprise, consist of, or consist essentially of a positive displacement drilling motor. In some embodiments, the drilling apparatus may comprise, consist of, or consist essentially of a progressing cavity drilling motor, including but not limited to a Moineau-type progressing cavity motor.

The drilling apparatus may be deployed in a borehole in any suitable manner. In some embodiments, the drilling apparatus may be configured to be deployed in a borehole on a drill string extending from the surface of the borehole. In some embodiments, the drill string may comprise lengths of drill pipe, casing, or tubing connected together. In some embodiments, the drill string may comprise a coiled tubing. In some embodiments, the drill string may comprise a wireline or a slickline.

The drilling apparatus comprises a housing. The housing may comprise a single housing component or may comprise a plurality of housing components. Housing components may be connected together in any suitable manner, including as a non-limiting example, with threaded connections or by welding.

In some embodiments, the drilling apparatus may comprise a bearing section, and the bearing section may comprise a bearing section housing. In some embodiments, the drilling apparatus may comprise a transmission section, and the transmission section may comprise a transmission section housing. In some embodiments, the drilling apparatus may comprise a power section, and the power section may comprise a power section housing. In some embodiments, the drilling apparatus may comprise other sections and other section housings. The housing of the drilling apparatus may comprise one or more of the section housings, which may be integral with each other or may be connected together in any suitable manner, including as a non-limiting example, with threaded connections or by welding.

The drilling apparatus comprises a driveshaft. The driveshaft may comprise a single driveshaft component or may comprise a plurality of driveshaft components. Driveshaft components may be integral with each other or may be connected together in any suitable manner, including as non-limiting examples, with threaded connections, with splines, or by welding.

The housing has a housing bore, a proximal housing end, a distal housing end, a housing axis, and a housing bore axis. The housing axis is defined by the exterior surface of the housing. The housing bore axis is defined by the housing bore.

The driveshaft is rotatably supported within the housing bore. The driveshaft may protrude from the distal housing end and/or from the proximal housing end. The driveshaft has an effective driveshaft axis which is defined by the axis of the driveshaft at an axial location at or adjacent to the distal housing end.

The drilling apparatus has a nominal drilling apparatus axis which is defined at and/or by the axis of the drilling apparatus at the proximal housing end. The nominal drilling apparatus axis represents the axis of the drilling apparatus in the absence of an angular offset between the proximal housing end and the distal housing end.

As used herein, "angular offset" means an angular deviation of the drilling apparatus or a component of the drilling apparatus from the nominal drilling apparatus axis. An angular offset of the drilling apparatus may be provided externally or internally.

As a non-limiting example, an angular offset may be provided externally by providing a bend in the housing which results in an angular deviation of both the housing axis and the housing bore axis relative to the nominal drilling apparatus axis. A bend in the housing may be provided in any suitable manner. In some embodiments, the housing may be fabricated with a bend or a bend may be imposed upon the housing following fabrication. In some embodiments, a bend may be provided by an oblique connection between housing components.

As a first non-limiting example, an angular offset may be provided internally by providing an angular deviation between the housing axis and the housing bore axis which results in an angular deviation of the housing bore axis relative to the nominal drilling apparatus axis. An angular deviation between the housing axis and the housing bore axis may be provided in any suitable manner. In some embodiments, the housing may be fabricated so that the housing axis is oblique to the housing bore axis.

As a second non-limiting example, an angular offset may be provided internally by providing an angular deviation within the housing bore which results in an angular deviation within the housing bore without providing an angular deviation of either the housing axis or the housing bore axis. An angular deviation within the housing bore may be provided in any suitable manner. In some embodiments, an angular deviation within the housing bore may be provided by receiving a sleeve assembly within the housing bore, wherein the sleeve assembly has a sleeve bore, a sleeve axis defined by an exterior surface of the sleeve assembly, and a sleeve bore axis defined by the sleeve bore, and wherein the angular deviation is provided between the sleeve axis and the sleeve bore axis so that the sleeve axis is oblique to the sleeve bore axis.

An angular offset of the drilling apparatus results in the effective driveshaft axis pointing in the direction of the angular offset, which facilitates directional drilling. A plurality of angular offsets may be completely or partially additive or may completely or partially cancel each other, depending upon the respective magnitudes and directions of the angular offsets.

The drilling apparatus further comprises a first angular offset axially located between the proximal housing end and the distal housing end. In some embodiments, the first angular offset may be a fixed first angular offset. As used herein, "fixed" first angular offset means that the first angular offset is not adjustable or variable in either magnitude or direction. The fixed first angular offset therefore has a first angular offset direction, which is fixed.

The fixed first angular offset may be provided externally and/or internally. In some embodiments, the fixed first angular offset may be provided externally by providing a bend in the housing. In some embodiments, the fixed first angular offset may be provided internally in order to avoid an angular deviation in the housing axis at the location of the fixed first angular offset.

In some embodiments, the fixed first angular offset may be provided internally by providing an angular deviation between the housing axis and the housing bore axis and/or by providing an angular deviation within the housing bore.

The drilling apparatus further comprises a second angular offset axially located between the proximal housing end and the distal housing end. In some embodiments, the second angular offset may be a variable second angular offset. As used herein, "variable" second angular offset means that the second angular offset may vary in magnitude and/or direction by adjustment and/or in response to the operating conditions and/or the environment of the drilling apparatus.

The variable second angular offset may be provided externally and/or internally. In some embodiments, the variable second angular offset may be provided externally by providing a bend in the housing. In some embodiments, the variable second angular offset may be provided internally in order to avoid an angular deviation in the housing axis at the location of the variable second angular offset.

In some embodiments, the variable second angular offset may be provided internally by providing an angular deviation between the housing axis and the housing bore axis and/or by providing an angular deviation within the housing bore.

The magnitude and/or direction of the variable second angular offset may be caused to vary in any suitable manner. In some embodiments, the variable second angular offset may vary as a result of a deliberate adjustment made to the drilling apparatus either before the drilling apparatus is deployed or during deployment of the drilling apparatus. In some embodiments, the variable second angular offset may vary in response to the operating conditions and/or environment to which the drilling apparatus is subjected.

In some embodiments, the magnitude of the variable second angular offset may be dependent upon a magnitude of an axial compressive force exerted on all or a portion of the drilling apparatus. The axial compressive force may be exerted on the drilling apparatus in any suitable manner. In some embodiments, the axial compressive force may be exerted on the drilling apparatus by a jack or other suitable device associated with the drilling apparatus. In some embodiments, the axial compressive force may be exerted on the drilling apparatus as a result of the operating conditions and/or environment to which the drilling apparatus is subjected. As a non-limiting example, in some embodiments the axial compressive force may be exerted on the drilling apparatus as a reaction force in response to weight-on-bit applied through the drilling apparatus.

In some embodiments, a threshold axial compressive force exerted on the drilling apparatus may cause the magnitude of the variable second angular offset to vary stepwise in any suitable manner from a first magnitude to a second magnitude. As a non-limiting example, a threshold axial compressive force may overcome a latching force which maintains the variable second angular offset at a particular magnitude.

In some embodiments, the magnitude of the variable second angular offset may vary gradually in any suitable manner between a first magnitude and a second magnitude in proportion to the magnitude of the axial compressive force which is exerted on the drilling apparatus. As a non-limiting example, the magnitude of the variable second angular offset may vary in any suitable manner as a linear or non-linear function of the magnitude of the axial compressive force which is exerted on the drilling apparatus.

The first magnitude and the second magnitude may be any magnitude of angular offset. In some embodiments, the second magnitude may be a maximum magnitude and the first magnitude may be a lesser magnitude or may be zero.

In some embodiments, the first magnitude may be a maximum magnitude and the second magnitude may be a lesser magnitude or may be zero.

In some embodiments, the drilling apparatus may comprise a reduced stiffness section so that the drilling apparatus bends preferentially at the reduced stiffness section. The drilling apparatus may bend preferentially at the reduced stiffness section omnidirectionally, or may bend preferentially at the reduced stiffness section in one or more selected directions.

In some embodiments, the variable second angular offset may be provided by and may be axially located at the reduced stiffness section.

The reduced stiffness section of the drilling apparatus may be provided in any suitable manner. In some embodiments, the reduced stiffness section may be provided by the material properties of the drilling apparatus, the geometrical properties of the drilling apparatus, or a combination thereof. As used herein, "material properties" means structural properties of the drilling apparatus resulting from the selection of materials from which the drilling apparatus is fabricated, including but not limited to modulus of elasticity. As used herein, "geometrical properties" means structural properties of the drilling apparatus resulting from the shape and boundary conditions of the drilling apparatus, including but not limited to moment of inertia.

The housing of the drilling apparatus has a housing wall. In some embodiments, the housing wall may have a reduced housing wall area at the reduced stiffness section, and the reduced stiffness section may be provided by the reduced housing wall area. As used herein, "reduced housing wall area" means a reduced amount of material in the cross-section of the housing wall at the location of the reduced stiffness section relative to other sections of the housing wall.

The reduced housing wall area may be provided in any suitable manner. In some embodiments, the reduced housing wall area may be provided by a reduced housing wall thickness. In some embodiments, the reduced housing wall area may be provided by one or more cavities defined in the housing wall. In some embodiments, the one or more cavities may comprise elongate holes having axes generally parallel with the housing axis.

The housing has a circumference. In some embodiments, the reduced housing wall area may be provided over the entire circumference of the housing at the reduced stiffness section so that the drilling apparatus bends preferentially omnidirectionally at the reduced stiffness section. In some embodiments, the reduced housing wall area may be provided over a portion of the circumference of the housing at the reduced stiffness section so that the drilling apparatus bends preferentially in a selected direction at the reduced stiffness section.

The selected direction may be any direction relative to the first angular offset direction. In some embodiments, the selected direction may be chosen so that the first angular offset direction and the selected direction are substantially the same direction. In some embodiments, the selected direction may be chosen so that the first angular offset direction is not the same as the selected direction. In some embodiments, the selected direction may be chosen so that the first angular offset direction is substantially opposite to the selected direction.

The fixed first angular offset and the variable second angular offset may be axially located at any position along the drilling apparatus and at any position relative to each other.

In some embodiments, the fixed first angular offset may be axially located between the variable second angular offset and the distal end of the housing, so that the fixed first angular offset is axially located relatively more distally along the drilling apparatus than the variable second angular offset.

In some embodiments, the drilling apparatus may comprise a bearing section. In some embodiments, the fixed first angular offset may be axially located at the bearing section of the drilling apparatus. The bearing section may be axially located at any position along the drilling apparatus. In some embodiments, the bearing section may be located at or adjacent to the distal housing end.

In some embodiments, the drilling apparatus may comprise a transmission section. In some embodiments, the variable second angular offset may be axially located at the transmission section of the drilling apparatus. The transmission section may be axially located at any position along the drilling apparatus. In some embodiments, the transmission section may be axially located relatively proximally to the bearing section so that the bearing section is axially located between the transmission section and the distal housing end. In some embodiments, the transmission section may be axially located adjacent to the bearing section.

In some embodiments, the variable second angular offset may be provided by a reduced stiffness section at the transmission section of the drilling apparatus. In some embodiments, the transmission section may comprise a transmission section housing, and the housing of the drilling apparatus may comprise the transmission section housing. In some such embodiments, the transmission section housing may have a housing wall and a reduced housing wall area at the reduced stiffness section, and the reduced stiffness section may be provided by the reduced housing wall area.

In some such embodiments, the reduced housing wall area may be provided over the entire circumference of the transmission section housing at the reduced stiffness section so that the drilling apparatus bends preferentially omnidirectionally at the reduced stiffness section. In some such embodiments, the reduced housing wall area may be provided over a portion of the circumference of the transmission section housing at the reduced stiffness section so that the drilling apparatus bends preferentially in a selected direction at the reduced stiffness section.

In such embodiments, the selected direction may be any direction relative to the first angular offset direction. In some such embodiments, the selected direction may be chosen so that the first angular offset direction and the selected direction are substantially the same direction. In some such embodiments, the selected direction may be chosen so that the first angular offset direction is not the same as the selected direction. In some such embodiments, the selected direction may be chosen so that the first angular offset direction is substantially opposite to the selected direction.

In some embodiments, the fixed first angular offset may be associated with a section of the drilling apparatus other than the bearing section. In some embodiments, the variable second angular offset may be associated with a section of the drilling apparatus other than the transmission section.

FIGS. 1-6 depict non-limiting examples of a drilling apparatus, wherein the drilling apparatus comprises a housing, a driveshaft rotatably supported within the housing, a fixed first angular offset, and a variable second angular offset.

Figure 2:
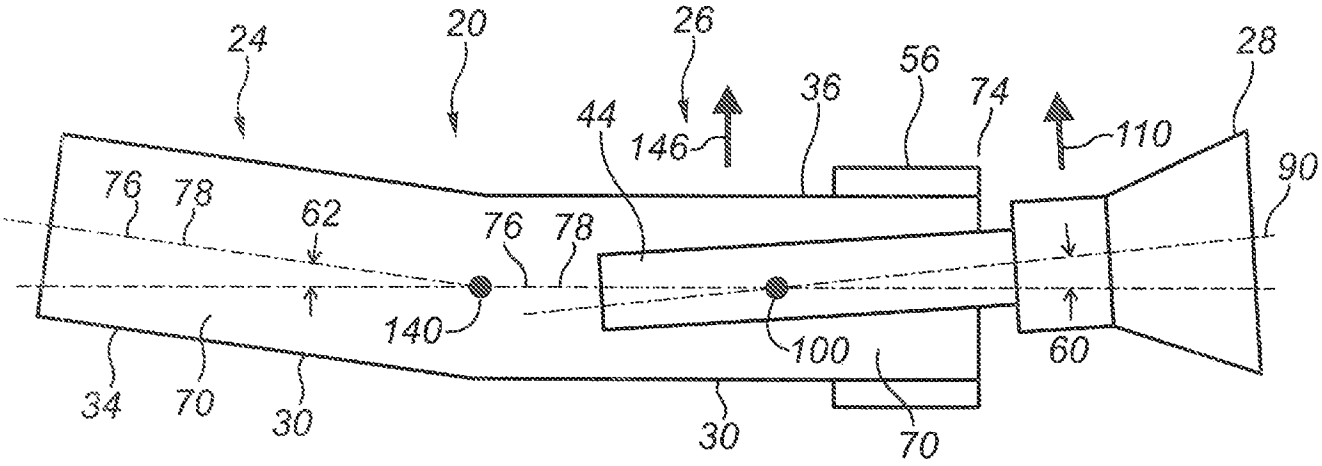
FIG. 2 is a schematic view of a drilling apparatus including two angular offsets, depicting the center points for the angular offsets.
Figure 3:
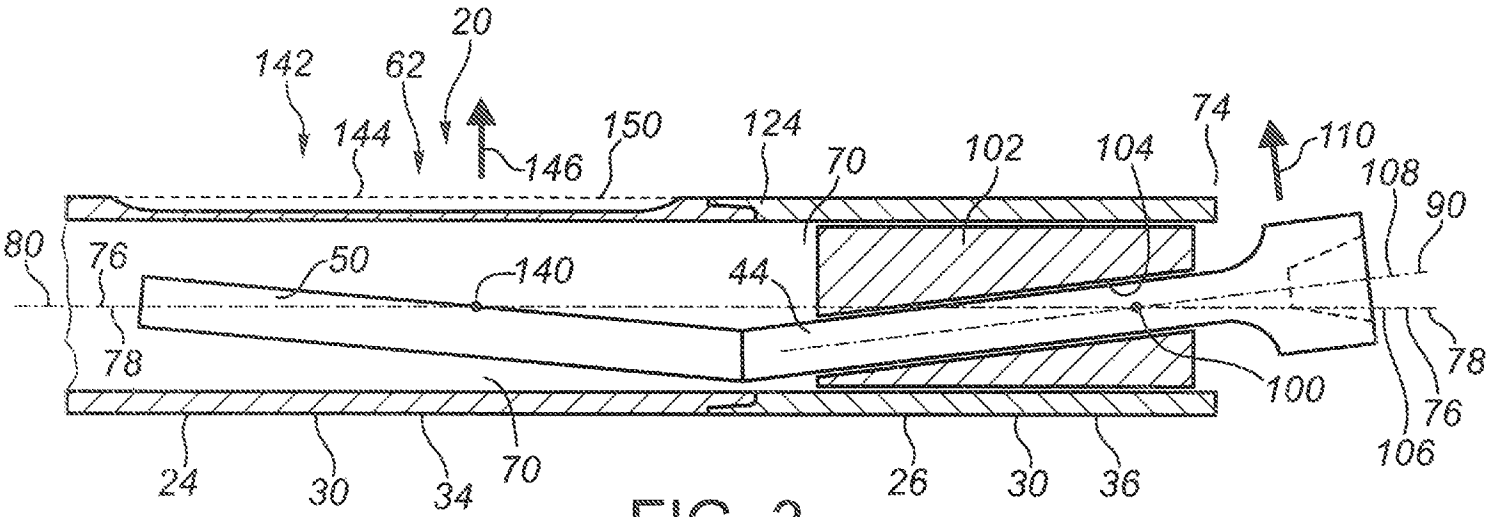
FIG. 3 is a schematic longitudinal section assembly view of a drilling apparatus including a fixed first angular offset and a variable second angular offset.
Figure 4A:
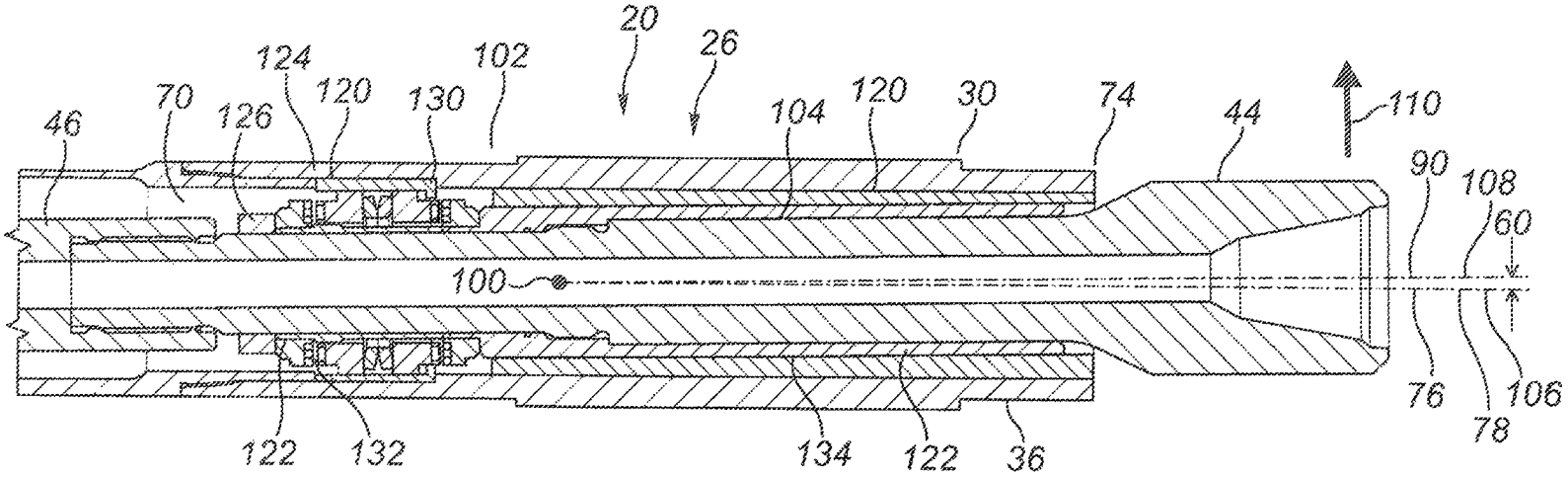
Figure 4B:
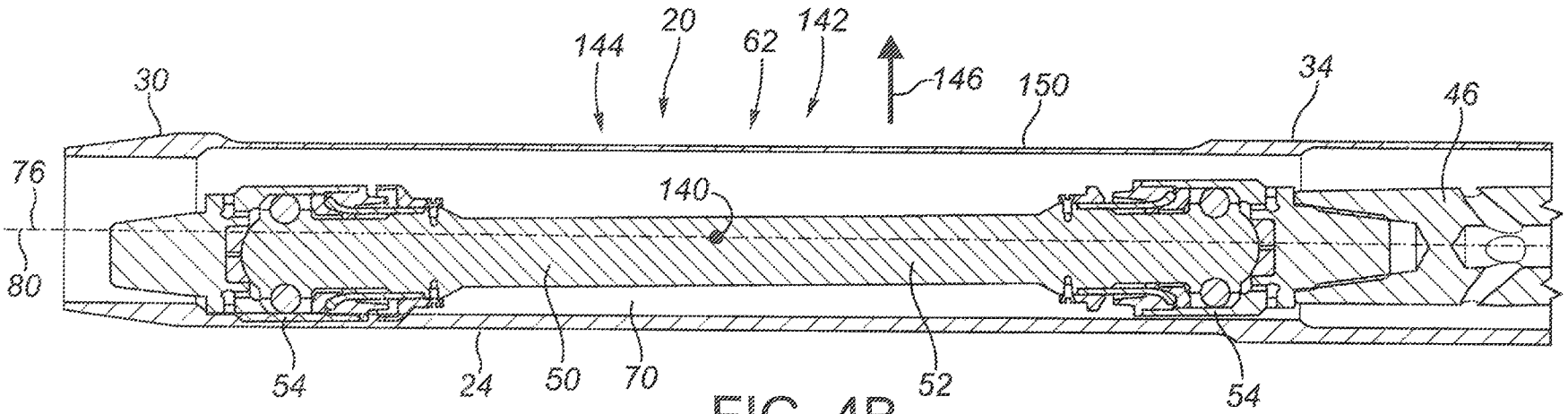
Figure 5A:
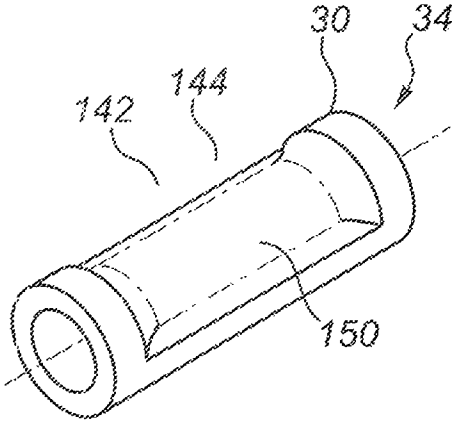
Figure 5B:
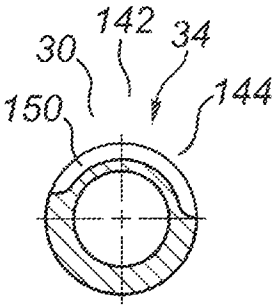
Figure 5C:
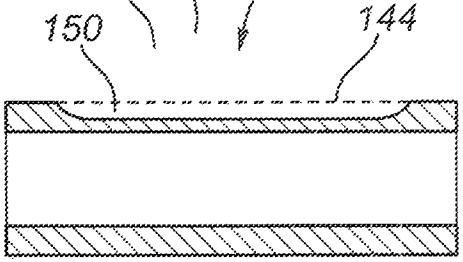
Figure 6A:
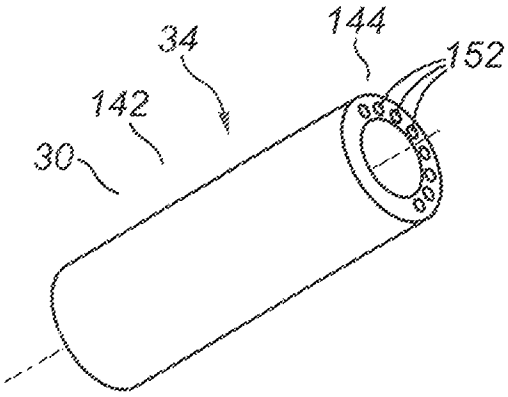
Figure 6B:
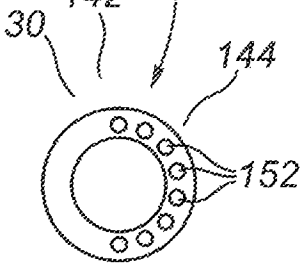
Figure 6C:
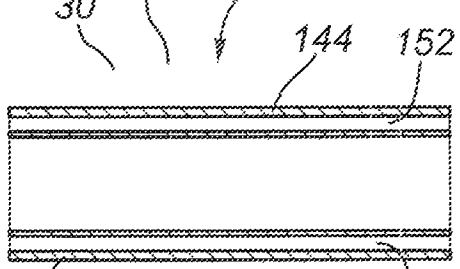

More particularly, FIG. 1 pictorially depicts a drilling motor as an exemplary type of drilling apparatus which may include the features described herein. FIG. 2 schematically depicts a drilling apparatus including two angular offsets. FIG. 3 schematically depicts a drilling apparatus including a fixed first angular offset and a variable second angular offset. FIG. 4A and FIG. 4B depict as longitudinal section assembly views a drilling apparatus including a fixed first angular offset and a variable second angular offset, with FIG. 4B being a proximal continuation of FIG. 4A. FIGS. 5A, 5B and 5C depict as isolated views a first exemplary embodiment of a reduced stiffness section in a drilling apparatus. FIGS. 6A, 6B and 6C depict as isolated views a second exemplary embodiment of a reduced stiffness section in a drilling apparatus.

FIGS. 1-6 are exemplary only. The features of the drilling apparatus depicted in FIGS. 1-6 and described herein may be included in alternate designs and types of drilling apparatus.

Referring to FIGS. 1-6, the exemplary drilling apparatus (20) described herein comprise a drilling motor for use in drilling a borehole. The drilling motor comprises a plurality of sections, only some of which are depicted in FIGS. 1-6.

Referring to FIG. 1, depicted are a power section (22), a transmission section (24), and a bearing section (26). These sections of the drilling motor constitute components of a powertrain which utilizes fluid energy to rotate a drill bit (28).

The sections (22, 24, 26) of the drilling motor are contained within a housing (30). As depicted in FIGS. 1-6, the housing (30) comprises a plurality of housing components connected together with threaded connections, including a power section housing (32) for the power section (22), a transmission section housing (34) for the transmission section (24), and a bearing section housing (36) for the bearing section (26).

The power section (22) of the drilling motor comprises a stator (40) and a rotor (42). The stator (40) is fixedly connected with the housing (30), and the rotor (42) is rotatable within the stator (40) in response to fluid circulating through the power section (22).

As depicted in FIG. 1, the power section (22) is a Moineau-type power section in which the stator (40) and the rotor (42) are lobed. The rotor (42) has one fewer lobe than the stator (40), and rotates within the stator (40) eccentrically relative to the axis of the power housing (32).

The transmission section (24) accommodates and converts the eccentric movement of the rotor (42) to concentric rotation of a driveshaft (44) within the bearing section (26).

As depicted in FIG. 1, the transmission section (24) comprises a transmission shaft (50) which is connected between the rotor (42) and the driveshaft (44) so that rotation of the rotor (42) causes rotation of the transmission shaft (50), and rotation of the transmission shaft (50) causes rotation of the driveshaft (44). As depicted in FIG. 1 and FIG. 4, the transmission shaft (50) comprises a rigid shaft (52) which is connected directly or indirectly between the rotor (42) and the driveshaft (44) with articulating connections (54) which are capable of accommodating the eccentric movement of the rotor (42). Alternatively, the transmission shaft (50) may comprise a flex shaft which is capable of accommodating the eccentric movement of the rotor (42) or may comprise a suitable alternate structure, device or apparatus which is capable of accommodating the eccentric movement of the rotor (42).

As depicted in FIG. 1, the bearing section (26) comprises portions of the driveshaft (44) and comprises a bearing assembly (not shown in FIG. 1) which rotatably supports the driveshaft (44) within the housing (30) so that rotation of the transmission shaft (50) causes rotation of the driveshaft (44). The bearing assembly may comprise one or more thrust bearings (not shown in FIG. 1) and one or more radial bearings (not shown in FIG. 1) for rotatably supporting the driveshaft (44).

As depicted in FIG. 1, the bearing section (26) may further comprise a stabilizer (56), which may be mounted on the exterior of the bearing section housing (36).

As depicted in FIG. 1, the drill bit (28) is connected with the driveshaft (44) so that rotation of the driveshaft (44) causes rotation of the drill bit (28).

Referring now to FIGS. 1-6, features of the drilling apparatus (20) are described in further detail, wherein FIGS. 1-5 depict an exemplary embodiment of the drilling apparatus (20), and FIGS. 6A, 6B and 6C depict features of an alternate embodiment of a reduced stiffness section.

Referring to FIGS. 1-4, the exemplary embodiment of the drilling apparatus (20) comprises the housing (30), the driveshaft (44), a fixed first angular offset (60), and a variable second angular offset (62).

The housing (30) has a housing bore (70), a proximal housing end (72) and a distal housing end (74). The proximal housing end (72) is adjacent to the proximal end of the power section (22) and the power section housing (32). The distal housing end (74) is adjacent to the distal end of the bearing section (26) and the bearing section housing (36).

A housing axis (76) is defined by the exterior surface of the housing (30). A housing bore axis (78) is defined by the housing bore (70). The proximal housing end (72) is configured to be connected with a drill string (not shown) for deployment in a borehole (not shown).

The drilling apparatus (20) has a nominal drilling apparatus axis (80) which is defined by the axis of the drilling apparatus (20) at the proximal housing end (72).

The driveshaft (44) is rotatably supported within the bearing section housing (30). In the exemplary embodiment, the driveshaft (44) protrudes from the distal housing end (74), which is at or adjacent to the distal end of the bearing section (26). The driveshaft (44) has an effective driveshaft axis (90) which is defined by the axis of the driveshaft (44) at or adjacent to the distal housing end (74).

In the exemplary embodiment, the driveshaft (44) comprises a driveshaft connector (46) which is used to connect the driveshaft (44) with the articulating connection (54) at the distal end of the transmission shaft (50).

Referring to FIGS. 2-3 and FIG. 4A, in the exemplary embodiment, the fixed first angular offset (60) is axially located at the bearing section (26), and is therefore axially located between the proximal housing end (72) and the distal housing end (74). The fixed first angular offset (60) has a center point (100).

In the exemplary embodiment, the housing axis (76) and the housing bore axis (78) along the bearing section (26) are substantially parallel, and the fixed first angular offset (60) is provided by an angular deviation within the housing bore (70). Referring to FIGS. 3-4, in the exemplary embodiment, the angular deviation within the housing bore (70) is provided by a sleeve assembly (102) which is received within the housing bore (70).

The sleeve assembly (102) has a sleeve bore (104). The driveshaft (44) extends through the sleeve bore (104). The exterior surface of the sleeve assembly (102) defines a sleeve axis (106) and the sleeve bore (104) defines a sleeve bore axis (108). An angular deviation is provided between the sleeve axis (106) and the sleeve bore axis (108) so that the sleeve axis (106) is oblique to the sleeve bore axis (108). As a result, the driveshaft (44) is tilted within the bearing section housing (36) relative to the housing axis (76) and the housing bore axis (78), thereby providing the fixed first angular offset (60) having a first angular offset direction (110) which is fixed.

In the exemplary embodiment, the sleeve assembly (102) comprises one or more stationary sleeve components (120) which are connected with the housing (30) with one or more threaded connections and one or more rotating sleeve components (122) which are connected with the driveshaft (44) with one or more threaded connections. Movement of the stationary sleeve components (120) in the proximal direction is limited by the distal end (124) of the transmission section housing (34). Movement of the rotating sleeve components (122) in the proximal direction is limited by a collar (126) on the driveshaft (44).

As depicted in FIG. 4A, the sleeve assembly (102) further comprises an on-bottom thrust bearing (130), an off-bottom thrust bearing (132) and radial bearing surfaces (134) which are interposed radially between the stationary sleeve components (120) and the rotating sleeve components (122) so that the driveshaft (44) is rotatably supported within the sleeve assembly (102).

Referring again to FIGS. 2-3 and FIG. 4B, in the exemplary embodiment, the variable second angular offset (62) is axially located at the transmission section (24), and is therefore axially located between the proximal housing end (72) and the distal housing end (74). The variable second angular offset (62) has a center point (140).

In the exemplary embodiment, the magnitude of the variable second angular offset (62) is dependent upon the magnitude of an axial compressive force which is exerted on the drilling apparatus (20), and in particular upon the transmission section (24).

As depicted in FIG. 4B, the magnitude of the variable second angular offset (62) is zero. FIG. 4B therefore depicts the exemplary embodiment with minimal axial compressive force being exerted on the drilling apparatus (20).

In the exemplary embodiment, the housing axis (76) and the housing bore axis (78) along the transmission section (24) are substantially parallel, and the variable second angular offset (62) is provided by a variable bend in the transmission section housing (34).

In the exemplary embodiment, the drilling apparatus (20) has a reduced stiffness section (142) at the transmission section (24) so that the transmission section housing (34) bends preferentially at the reduced stiffness section (142), and the variable second angular offset (62) is axially located at the reduced stiffness section (142).

In the exemplary embodiment, the reduced stiffness section (142) is provided by the geometrical properties of the transmission section (24). In particular, in the exemplary embodiment, the transmission section housing (34) has a reduced housing wall area (144) in the housing wall of the transmission section housing (34) at the reduced stiffness section (142) so that the reduced stiffness section (142) is provided by the reduced housing wall area (144).

In the exemplary embodiment, the reduced housing wall area (144) is provided over a portion of the circumference of the transmission section housing (34) so that the transmission section housing (34) and thus the drilling apparatus (20) bends preferentially in a selected direction (146) at the reduced stiffness section (142). In the exemplary embodiment, the portion of the circumference is between about 40 and about 50 percent of the circumference. The transmission section housing (34) bends preferentially toward the reduced housing wall area (144), so that the selected direction (146) is defined by the circumferential location of the reduced housing wall area (144).

In the exemplary embodiment, the transmission section housing (34) may bend between a first magnitude which is equal to zero (i.e., so that the transmission section housing (34) is straight) when no axial compressive force is exerted on the transmission section housing (34), to a second magnitude (i.e, a maximum bend of the transmission section housing (34)) which is dependent upon the amount of axial compressive force which is exerted on the transmission section housing (34) and which is also dependent upon the material properties and the geometrical properties of the transmission section housing (34). As non-limiting examples, the second magnitude of the bend may be dependent upon the extent of the reduction of material in the reduced housing wall area, upon the axial length of the reduced housing wall area (144), and/or upon the material from which the transmission section housing (34) is fabricated at the location of the reduced housing wall area (144).

Referring to FIGS. 3, 4B and 5A-5C, a first exemplary embodiment of a reduced stiffness section (142) comprising a reduced housing wall area (144) is depicted. In FIGS. 3-5, the reduced housing wall area (144) is provided by a reduced housing wall thickness (150) in the transmission section housing (34).

Referring to FIGS. 6A-6C, a second exemplary embodiment of a reduced stiffness section (142) comprising a reduced housing wall area (144) is depicted. In FIGS. 6A-6C, the reduced housing wall area (144) is provided by a plurality of cavities (152) defined in the housing wall of the transmission section housing (34). In the second exemplary embodiment of the reduced stiffness section (142), the plurality of cavities (150) comprise elongate holes having axes generally parallel with the housing axis (76) at the transmission section (24).

As can be seen from FIGS. 1-4, previously indicated, in the exemplary embodiment, the bearing section (26) is axially located between the transmission section (24) and the distal housing end (74), the fixed first angular offset (60) is axially located at the bearing section (26), and the variable second angular offset (62) is axially located at the transmission section (24). As a result, in the exemplary embodiment, the fixed first angular offset (60) is axially located between the variable second angular offset (62) and the distal housing end (74).

In the exemplary embodiment of the drilling apparatus (20) depicted in FIGS. 1-6, the drilling apparatus (20) is configured so that the first angular offset direction (110) of the fixed first angular offset (60) and the selected direction (146) of the variable second angular offset (62) are the same direction, so that the variable second angular offset (62) adds to and supplements the fixed first angular offset (60) and so that the magnitudes of the fixed first angular offset (60) and the variable second angular offset (62) are additive.

In the exemplary embodiment, the additive effects of the fixed first angular offset (60) and the variable second angular offset (62) result in the effective driveshaft axis (90) being angularly offset from the nominal drilling apparatus (80) by an amount which may be equal to or nearly equal to the sum of the magnitudes of the fixed first angular offset (60) and the variable second angular offset (62).

In use, the exemplary embodiment of the drilling apparatus (20) described herein may define a substantially straight housing axis (76) between the proximal housing end (72) and the distal housing end (74) when inserted within and being advanced through a borehole, since the fixed first angular offset (60) is provided by an angular deviation within the housing bore (70) and not by a bend in the housing (30), and since the variable second angular offset (62) is zero in the absence of an axial compressive force being exerted on the drilling apparatus (20).

A substantially straight housing axis (76) may assist in minimizing the lateral and bending stresses which are exerted on the drilling apparatus (20) while it is being advanced through a borehole. The reduced stiffness section (142) of the drilling apparatus (20) may also assist in enabling the drilling apparatus (20) to advance through bends in a borehole, since the reduced stiffness section (142) may provide a natural bend point for the drilling apparatus (20).

Upon the application of a weight-on-bit through the drilling apparatus (20), the fixed first angular offset (60) will maintain its magnitude and direction, but will be supplemented by the variable second angular offset (62), which in the exemplary embodiment is dependent upon the magnitude of the weight-on-bit and the extent to which the weight-on-bit is transmitted through the transmission section housing (34).

The drilling apparatus (20) as described herein may therefore be capable of achieving a relatively higher build-angle during directional drilling than if the variable second angular offset (62) were not provided, and/or the magnitude of the fixed first angular offset (60) required to achieve a particular build-angle during directional drilling may be less than if the variable second angular offset (62) were not provided.

An exemplary, non-limiting method for using a drilling apparatus (20) having a fixed first angular offset (60) and a variable second angular offset (62), including but not limited to the exemplary embodiment of the drilling apparatus (20) described herein, may comprise the following operations (which may be performed in any suitable order and which may be repeated as necessary):

1. assembling and/or providing the drilling apparatus (20), with a drill bit (28) attached to the driveshaft (44);
2. connecting the drilling apparatus (20) with a pipe string (not shown);
3. inserting the drilling apparatus (20) and the pipe string into a borehole (not shown);
4. advancing the drilling apparatus (20) through the borehole with the pipe string until the drill bit (28) engages the end of the borehole;
5. applying weight-on-bit to the drill bit (28) by lowering or otherwise applying a downward force through the pipe string, thereby increasing the magnitude of the variable second angular offset (62) as a result of a reactive axial compressive force from the end of the borehole being transmitted through the drilling apparatus (20) by the drill bit (28);
6. circulating drilling fluid through the drilling apparatus (20) in order to drive the power section (22) of the drilling apparatus (20) and rotate the drill bit (28);
7. performing directional drilling in a direction determined by the first angular offset direction (110) of the fixed first angular offset (60) and the selected direction (146) of the variable second angular offset (62);
8. ceasing circulating drilling fluid through the drilling apparatus (20) in order to cease directional drilling;
9. removing the weight-on-bit from the drill bit (28) by lifting the drill string, thereby reducing the magnitude of the variable second angular offset (62); and
10. withdrawing the drill string and the drilling apparatus (20) from the borehole.

ADDITIONAL DISCLOSURES

The following are non-limiting, specific embodiments of the drilling apparatus described herein:

Embodiment A

A drilling apparatus comprising:

(a) a housing having a housing bore, a proximal housing end and a distal housing end;
(b) a driveshaft rotatably supported within the housing bore;
(c) a fixed first angular offset axially located between the proximal housing end and the distal housing end; and
(d) a variable second angular offset axially located between the proximal housing end and the distal housing end.

Embodiment B

The drilling apparatus of Embodiment A wherein the drilling apparatus has a reduced stiffness section so that the drilling apparatus bends preferentially at the reduced stiffness section, and wherein the variable second angular offset is axially located at the reduced stiffness section.

Embodiment C

The drilling apparatus of Embodiment B wherein the reduced stiffness section is provided by the material properties of the drilling apparatus, the geometrical properties of the drilling apparatus, or a combination thereof.

Embodiment D

The drilling apparatus of any one of Embodiments B or C wherein the housing has a housing wall, wherein the housing wall has a reduced housing wall area at the reduced stiffness section, and wherein the reduced stiffness section is provided by the reduced housing wall area.

Embodiment E

The drilling apparatus of Embodiment D wherein the housing has a circumference and wherein the reduced housing wall area is provided over a portion of the circumference of the housing so that the drilling apparatus bends preferentially in a selected direction at the reduced stiffness section.

Embodiment F

The drilling apparatus of any one of Embodiments D or E wherein the reduced housing wall area is provided by a reduced housing wall thickness.

Embodiment G

The drilling apparatus of any one of Embodiments D or E wherein the reduced housing wall area is provided by one or more cavities defined in the housing wall.

Embodiment H

The drilling apparatus of any one of Embodiments A through G wherein the drilling apparatus comprises a bearing section and wherein the fixed first angular offset is axially located at the bearing section.

Embodiment I

The drilling apparatus of any one of Embodiments A through H wherein the drilling apparatus comprises a transmission section and wherein the variable second angular offset is axially located at the transmission section.

Embodiment J

The drilling apparatus of any one of Embodiments B or C wherein the drilling apparatus comprises a bearing section and wherein the fixed first angular offset is axially located at the bearing section.

Embodiment K

The drilling apparatus of any one of Embodiments B or C wherein the drilling apparatus comprises a transmission section and wherein the variable second angular offset is axially located at the transmission section.

Embodiment L

The drilling apparatus of Embodiment J wherein the drilling apparatus comprises a transmission section and wherein the variable second angular offset is axially located at the transmission section.

Embodiment M

The drilling apparatus of any one of Embodiments K or L wherein the transmission section comprises a transmission section housing, wherein the housing comprises the transmission section housing, wherein the transmission section housing has a housing wall, wherein the transmission section housing has a reduced housing wall area at the reduced stiffness section, and wherein the reduced stiffness section is provided by the reduced housing wall area.

Embodiment N

The drilling apparatus of Embodiment M wherein the transmission section housing has a circumference and wherein the reduced housing wall area is provided over a portion of the circumference of the transmission section housing so that the drilling apparatus bends preferentially in a selected direction at the reduced stiffness section.

Embodiment O

The drilling apparatus of any one of Embodiments M or N wherein the reduced housing wall area is provided by a reduced housing wall thickness.

Embodiment P

The drilling apparatus of any one of Embodiments M or N wherein the reduced housing wall area is provided by one or more cavities defined in the housing wall.

Embodiment Q

The drilling apparatus of any one of Embodiments A through P wherein a magnitude of the variable second angular offset is dependent upon a magnitude of an axial compressive force exerted on the drilling apparatus.

Embodiment R

The drilling apparatus of any one of Embodiments A through Q wherein the fixed first angular offset has a first angular offset direction, wherein the variable second angular offset has a selected direction, and wherein the first angular offset direction and the selected direction are the same direction.

Embodiment S

The drilling apparatus of any one of Embodiments A through R wherein the housing has a housing axis, wherein the housing bore has a housing bore axis, and wherein the fixed first angular offset comprises a bend in the housing, an angular deviation between the housing axis and the housing bore axis, an angular deviation within the housing bore, or a combination thereof.

Embodiment T

The drilling apparatus of any one of Embodiments A through S wherein the fixed first angular offset is axially located between the variable second angular offset and the distal end of the housing.

Embodiment U

The drilling apparatus of any one of Embodiments A through T wherein the drilling apparatus is an apparatus for use in drilling a borehole.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

We claim:

1. A drilling apparatus comprising:

(a) a housing having a housing bore, a proximal housing end and a distal housing end;

(b) a driveshaft rotatably supported within the housing bore;

(c) a fixed first angular offset axially located between the proximal housing end and the distal housing end; and (d) a variable second angular offset axially located between the proximal housing end and the distal housing end, wherein the drilling apparatus has a reduced stiffness section so that the drilling apparatus bends preferentially at the reduced stiffness section, wherein the variable second angular offset is axially located at the reduced stiffness section, wherein the housing has a housing wall and a circumference, wherein the housing wall has a reduced housing wall area at the reduced stiffness section, wherein the reduced stiffness section is provided by the reduced housing wall area, and wherein the reduced housing wall area is provided over a portion of the circumference of the housing so that the drilling apparatus bends preferentially in a selected direction at the reduced stiffness section.

2. The drilling apparatus as claimed in claim 1 wherein a magnitude of the variable second angular offset is dependent upon a magnitude of an axial compressive force exerted on the drilling apparatus.

3. The drilling apparatus as claimed in claim 1 wherein the fixed first angular offset has a first angular offset direction, and wherein the first angular offset direction and the selected direction are the same direction.

4. The drilling apparatus as claimed in claim 1 wherein the reduced housing wall area is provided by a reduced housing wall thickness.

5. The drilling apparatus as claimed in claim 1 wherein the reduced housing wall area is provided by one or more cavities defined in the housing wall.

6. The drilling apparatus as claimed in claim 1 wherein the housing has a housing axis, wherein the housing bore has a housing bore axis, and wherein the fixed first angular offset comprises a bend in the housing, an angular deviation between the housing axis and the housing bore axis, an angular deviation within the housing bore, or a combination thereof.

7. The drilling apparatus as claimed in claim 6 wherein the fixed first angular offset is axially located between the variable second angular offset and the distal housing end.

8. The drilling apparatus as claimed in claim 7 wherein the drilling apparatus comprises a transmission section and wherein the variable second angular offset is axially located at the transmission section.

9. The drilling apparatus as claimed in claim 1 wherein the drilling apparatus is an apparatus for use in drilling a borehole.

10. A drilling apparatus comprising:

(a) a housing having a housing bore, a proximal housing end and a distal housing end;

(b) a driveshaft rotatably supported within the housing bore;

(c) a fixed first angular offset axially located between the proximal housing end and the distal housing end, wherein the housing has a housing axis, wherein the housing bore has a housing bore axis, wherein the fixed first angular offset comprises a bend in the housing, an angular deviation between the housing axis and the housing bore axis, an angular deviation within the housing bore, or a combination thereof, wherein the drilling apparatus comprises a bearing section and wherein the fixed first angular offset is axially located at the bearing section; and (d) a variable second angular offset axially located between the proximal housing end and the distal housing end, wherein the drilling apparatus has a reduced stiffness section so that the drilling apparatus bends preferentially at the reduced stiffness section, wherein the variable second angular offset is axially located at the reduced stiffness section, wherein the reduced stiffness section is provided by the material properties of the drilling apparatus, the geometrical properties of the drilling apparatus, or a combination thereof, and wherein the fixed first angular offset is axially located between the variable second angular offset and the distal housing end.

11. The drilling apparatus as claimed in claim 10 wherein the housing has a housing wall, wherein the housing wall has a reduced housing wall area at the reduced stiffness section, and wherein the reduced stiffness section is provided by the reduced housing wall area.

12. The drilling apparatus as claimed in claim 10 wherein the drilling apparatus comprises a transmission section and wherein the variable second angular offset is axially located at the transmission section.

13. The drilling apparatus as claimed in claim 12 wherein the transmission section comprises a transmission section housing, wherein the housing comprises the transmission section housing, wherein the transmission section housing has a housing wall, wherein the transmission section housing has a reduced housing wall area at the reduced stiffness section, and wherein the reduced stiffness section is provided by the reduced housing wall area.

14. The drilling apparatus as claimed in claim 13 wherein the transmission section housing has a circumference and wherein the reduced housing wall area is provided over a portion of the circumference of the transmission section housing so that the drilling apparatus bends preferentially in a selected direction at the reduced stiffness section.

15. The drilling apparatus as claimed in claim 14 wherein the fixed first angular offset has a first angular offset direction, and wherein the first angular offset direction and the selected direction are the same direction.

16. The drilling apparatus as claimed in claim 14 wherein the reduced housing wall area is provided by a reduced housing wall thickness.

17. The drilling apparatus as claimed in claim 14 wherein the reduced housing wall area is provided by one or more cavities defined in the housing wall.

18. The drilling apparatus as claimed in claim 10 wherein a magnitude of the variable second angular offset is dependent upon a magnitude of an axial compressive force exerted on the drilling apparatus.

19. The drilling apparatus as claimed in claim 10 wherein the housing has a housing axis, wherein the housing bore has a housing bore axis, and wherein the fixed first angular offset comprises a bend in the housing, an angular deviation between the housing axis and the housing bore axis, an angular deviation within the housing bore, or a combination thereof.

20. The drilling apparatus as claimed in claim 10 wherein the drilling apparatus is an apparatus for use in drilling a borehole.

* * * * *